US007251967B2

(12) United States Patent
Yang

(10) Patent No.: US 7,251,967 B2
(45) Date of Patent: Aug. 7, 2007

(54) PADLOCK HAVING A STORAGE CHAMBER

(76) Inventor: Yao-Kun Yang, No. 101, Lane 93, Chang Lu Road, Chang Hua City (TW)

( * ) Notice: Subject to any disclaimer, the term of this patent is extended or adjusted under 35 U.S.C. 154(b) by 0 days.

(21) Appl. No.: 11/375,249

(22) Filed: Mar. 15, 2006

(65) Prior Publication Data

US 2006/0213237 A1 Sep. 28, 2006

(51) Int. Cl.
*E05B 65/52* (2006.01)

(52) U.S. Cl. ..... 70/63; 70/25; 70/38 A; 70/38 C; 70/312; 70/DIG. 63

(58) Field of Classification Search ..... 70/284, 70/285, 63, DIG. 63, 54–56, DIG. 71, 21, 70/24–26, 38 R, 38 A, 38 C, 312
See application file for complete search history.

(56) References Cited

U.S. PATENT DOCUMENTS 4,325,240 A * 4/1982 Gable ..... 70/284
4,641,505 A * 2/1987 Maurice ..... 70/63
4,649,723 A * 3/1987 Appelbaum ..... 70/63
4,838,052 A * 6/1989 Williams et al. ..... 70/63
4,988,987 A * 1/1991 Barrett et al. ..... 340/5.28
5,134,869 A * 8/1992 Gable ..... 70/63
5,737,947 A * 4/1998 Ling ..... 70/63
6,834,519 B1 * 12/2004 Yang ..... 70/58
7,086,258 B2 * 8/2006 Fisher et al. ..... 70/278.7
2004/0226325 A1 * 11/2004 Ling ..... 70/63
2005/0223758 A1 * 10/2005 Yu ..... 70/63
2005/0229655 A1 * 10/2005 Yu ..... 70/63

* cited by examiner

*Primary Examiner*—Lloyd A. Gall
(74) *Attorney, Agent, or Firm*—Browdy and Neimark, PLLC

(57) ABSTRACT

A padlock includes a base shell, a cover shell pivoted to and openably covered on the base shell to define with the base shell a storage chamber therebetween, a shackle movably mounted in the base shell, and two combination lock sets each having a latch engagable with the base shell for locking the cover shell to the base shell, a plurality of numbered wheels extending out of through holes of the cover shell, and a movable plate actuatable by the numbered wheels to move relative to the latch for engaging or disengaging the latch to further have the latch engage or disengage with the base shell so as to lock or unlock the cover shell to the base shell.

8 Claims, 5 Drawing Sheets

PADLOCK HAVING A STORAGE CHAMBER

BACKGROUND OF THE INVENTION

1. Field of the Invention

The present invention relates to locks and more particularly, to a padlock, which has two combination lock sets and a storage chamber for keeping small things.

2. Description of the Related Art

Conventional locks mainly include two types, namely, the combination lock operatable by a set of numbered wheels and the pin tumbler lock operatable by a key. A regular combination lock comprises a casing, a shackle, and a set of numbered wheels mounted in the casing. The casing has a plurality of through holes for accommodating the numbered wheels. The user can rotate the numbered wheels to show the correct number combination, thereby unlocking the shackle. There is also known a combination lock that provides a set of pushbutton digits for pressing by the user to input the correct number combination to unlock the lock.

Conventional combination locks commonly use three or four numbered wheels to compose number combinations. This design provides only a limited number of number combinations, and a thief can solve the riddle to get the correct number combination within a short time. Further, after a long use of a combination lock that provides a set of pushbutton digits, the pushbuttons may become loosened. In this case, a thief can easily solve the riddle to get the correct number combination of the combination lock easily. Therefore, the aforesaid conventional combination locks have low security.

SUMMARY OF THE INVENTION

The present invention has been accomplished under the circumstances in view. It is therefore one objective of the present invention to provide a padlock, which uses two combination lock sets to complicate the riddle of the number combinations, increasing the security level.

It is another objective of the present invention to provide a padlock, which has a storage chamber for keeping keys, memo, or other small items.

To achieve these objectives of the present invention, the padlock comprises a base shell, a cover shell, a shackle assembly, and two combination lock sets. The cover shell is pivoted to and openably covered on the base shell to define with the base shell a storage chamber therebetween. The cover shell has a plurality of through holes in communication with the storage chamber. The shackle assembly has a shackle movably mounted in the base shell. The combination lock sets are mounted to the cover shell inside the storage chamber. Each of the combination lock sets has a latch engagable with the base shell for locking the cover shell to the base shell, a plurality of numbered wheels respectively peripherally extending out of the through holes of the cover shell, and a movable plate actuatable by the numbered wheels to move relative to the latch for engaging or disengaging the latch to further have the latch engage or disengage with the base shell so as to lock or unlock the cover shell to the said base shell.

DETAILED DESCRIPTION OF THE INVENTION

Figure 1:
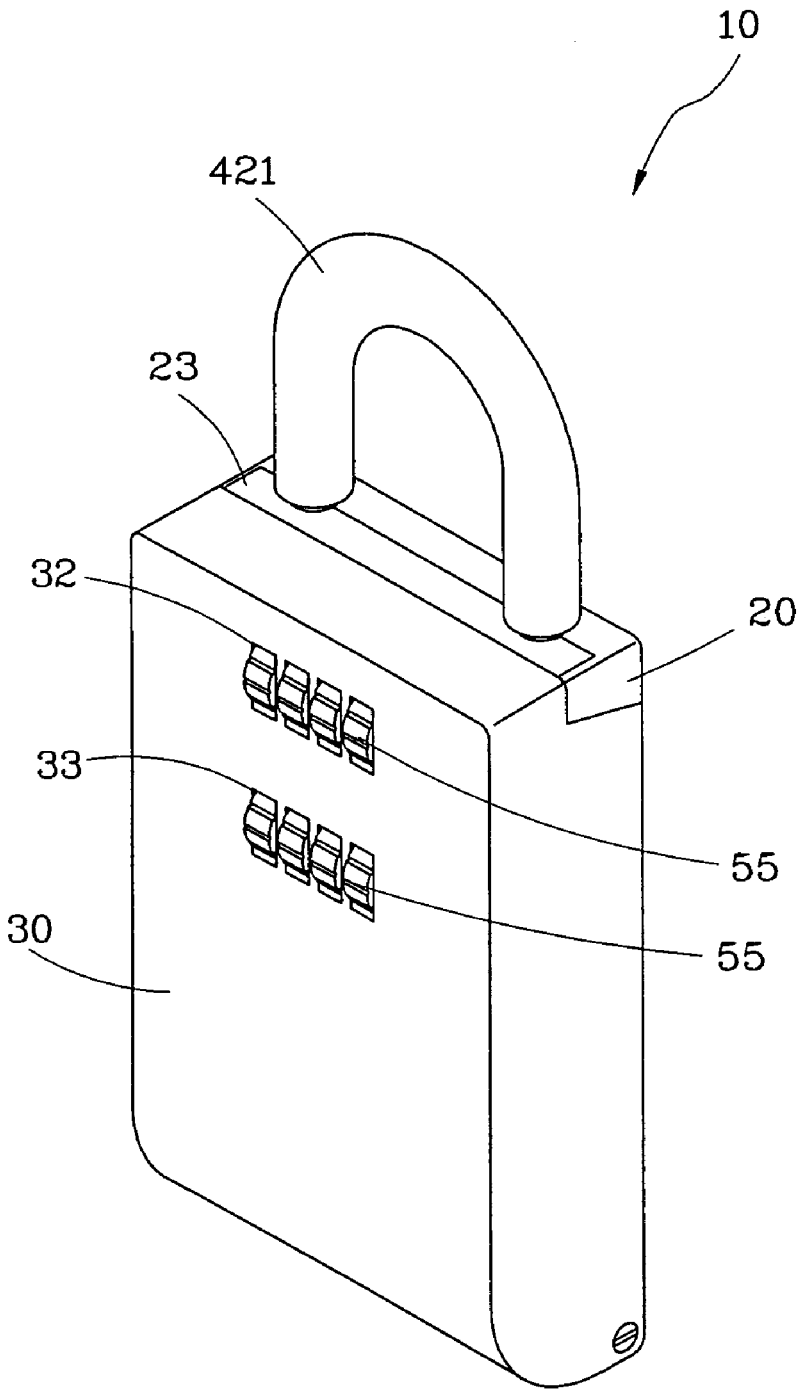
FIG. 1 is a perspective view of a padlock according to a preferred embodiment of the present invention.
Figure 2:
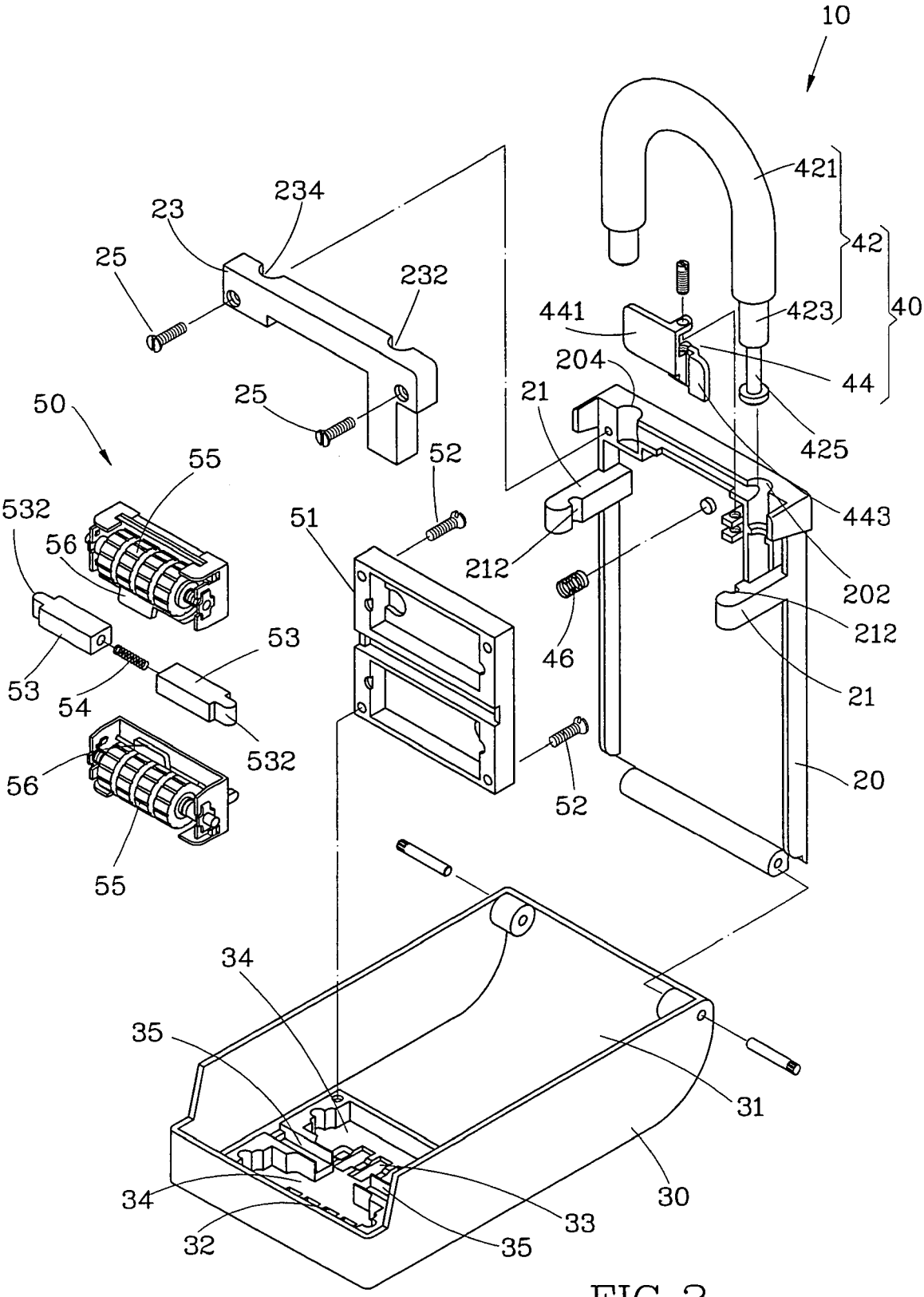
FIG. 2 is an exploded view of the padlock according to the preferred embodiment of the present invention.

As shown in FIGS. 1 and 2, a padlock 10 in accordance with the preferred embodiment of the present invention comprises a base shell 20, a locating bar 23, a cover shell 30, a shackle assembly 40, and two combination lock sets 50.

The base shell 20 is a rectangular shell, having a first shackle groove 202 and a second shackle groove 204 bilaterally disposed at the top and arranged in parallel, and two posts 21 bilaterally perpendicularly extending from the front side and having respectively an inner notch 212 near the free end. The shackle grooves 202 and 204 have a semicircular cross section. The locating bar 23 is affixed to the base shell 20 with fastening members, for example, tie screws 25. The locating bar 23 has a first shackle groove 232 and a second shackle groove 234 that match the first shackle groove 202 and second shackle groove 204 of the base shell 20 respectively. The first shackle groove 232 and the second shackle groove 234 have a semicircular cross section. After installation of the locating bar 23 in the base shell 20, the first shackle grooves 202 and 232 form a round through hole for receiving a part of the shackle assembly 40, and the second shackle grooves 204 and 234 form another round through hole for receiving another part of the shackle assembly 40.

The cover shell 30 has the bottom side thereof pivotally connected to the bottom side of the base shell 20. Therefore, the cover shell 30 can be closed on the base shell 20 or opened from the base shell 20. When the cover shell 30 is closed on the base shell 20, the peripheral wall of the cover shell 30 is closely abutted against the peripheral wall of the base shell 20, thereby defining a storage chamber 31 in between the base shell 20 and the cover shell 30. The cover shell 30 has a plurality of first rectangular through holes 32 and a plurality of second rectangular through holes 33 symmetrically arranged at two different elevations in communication with the storage chamber 31, two compartments 34 respectively disposed corresponding to the first rectangular through holes 32 and the second rectangular through holes 33, and two transverse grooves 35 bilaterally set between the compartments 34 and aligned in a line.

The shackle assembly 40 comprises a substantially U-shaped shackle 42 and a control member 44. The shackle 42 comprises a substantially U-shaped shackle body 421, and a straight endpiece 423 axially extending from one end of the shackle body 421. The straight endpiece 423 is pivotally and axially movably mounted in the round hole of the first shackle grooves 202 and 232, for enabling the other end of the shackle body 421 to be inserted into the round hole of the second shackle grooves 204 and 234. Further, the straight endpiece 423 of the shackle 42 has a neck 425 disposed inside the round hole of the first shackle grooves 202 and 232. The control member 44 is pivotally mounted inside the base shell 20 and provided with an actuating portion 441 and a retaining portion 443 at two sides of the pivoted middle part thereof to the base shell 20. The retaining portion 443 is attached to the neck 425 of the endpiece 423 of the shackle 42 to stop the shackle 42 from axial movement relative to the base shell 20. When pressed the actuating portion 441, the control member 44 is biased to disengage the retaining portion 443 from the neck 425 of the endpiece 423, and therefore the shackle 42 is unlocked. The shackle assembly 40 further comprises a spring member 46 stopped between the actuating portion 441 and the base shell 20. The spring member 46 imparts an outward force to the actuating portion 441, thereby holding the retaining portion 443 in engagement with the neck 425 of the endpiece 423 of the shackle 42.

Figure 3:
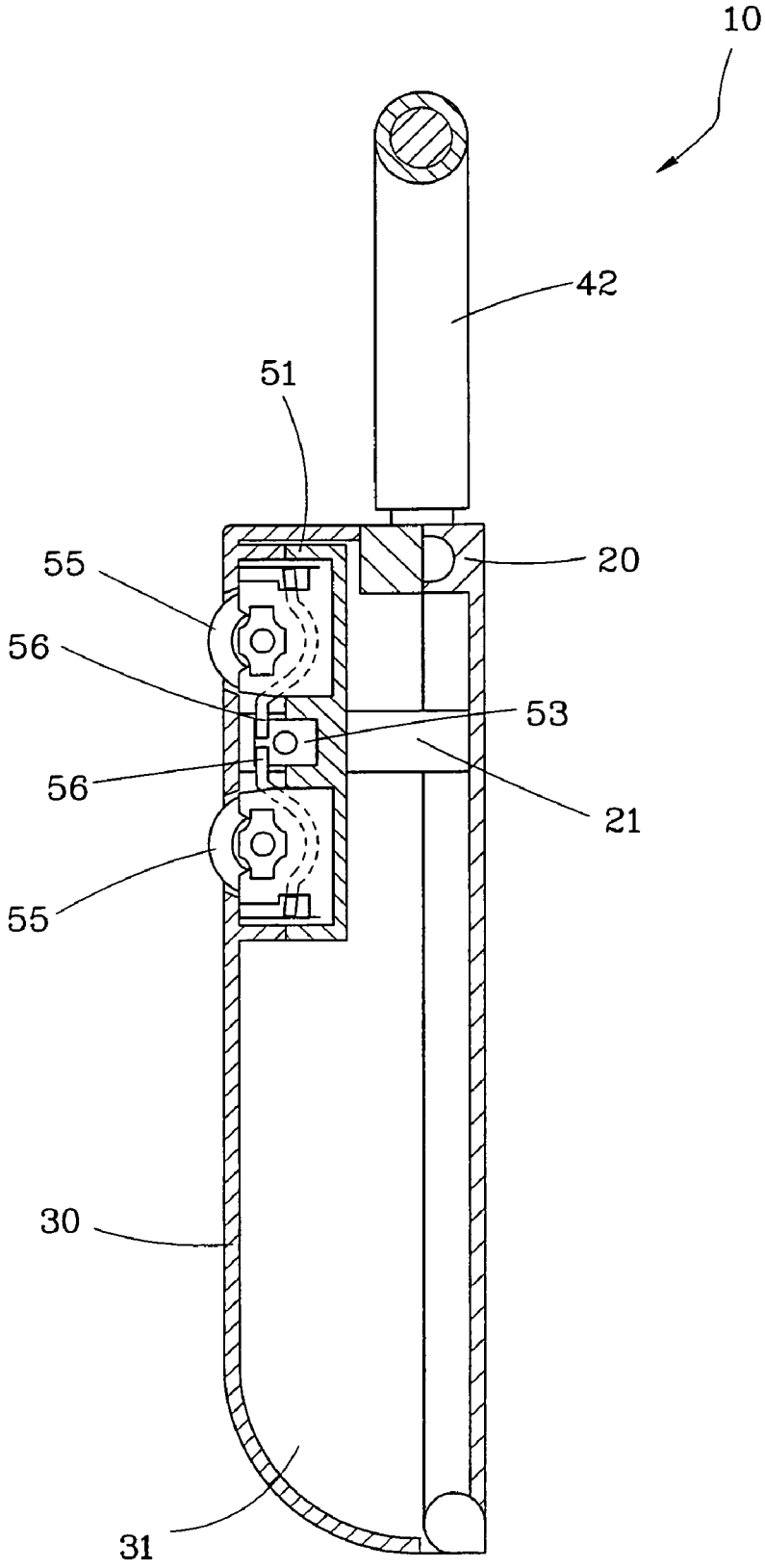
FIG. 3 is a sectional view of the preferred embodiment of the present invention, showing the movable plates stopped against the respective latches.

Referring to FIG. 3 and FIGS. 1 and 2 again, the two combination lock sets 50 are located inside the chamber 31. The combination lock sets each have a set of numbered wheels 55 and a movable plate 56. A holder frame 51 is affixed to the cover shell 30 with fastening members, for example, tie screws 52 to hold the two combination lock sets 50 in the compartments 34 respectively and to have the numbered wheels 55 be respectively peripherally extended out of the first and second rectangular through holes 32 and 33 of the cover shell 30. The two combination lock sets 50 further comprise two latches 53 respectively slidably mounted in the transverse grooves 35 of the cover shell 30, and a spring member 54. Each of the latches 53 has a front end terminating in a tongue 532 corresponding to the inner notches 212 of the posts 21. The spring member 54 is stopped between the rear ends of the latches 53 and adapted to force the tongues 532 of the latches 53 into engagement with the inner notches 212 of the posts 21. The two movable plates 56 are respectively coupled to the two numbered wheel sets 55 for stopping against the rear ends of the latches 53 to prohibit displacement of the latches 53 in the grooves 35. When the cover shell 30 is in the opened status, the movable plates 56 are disengaged from the latches 53 for allowing movement of the latches 53 in the respective grooves 35 away from the inner notches 212 of the posts 21.

Figures 4, 5:
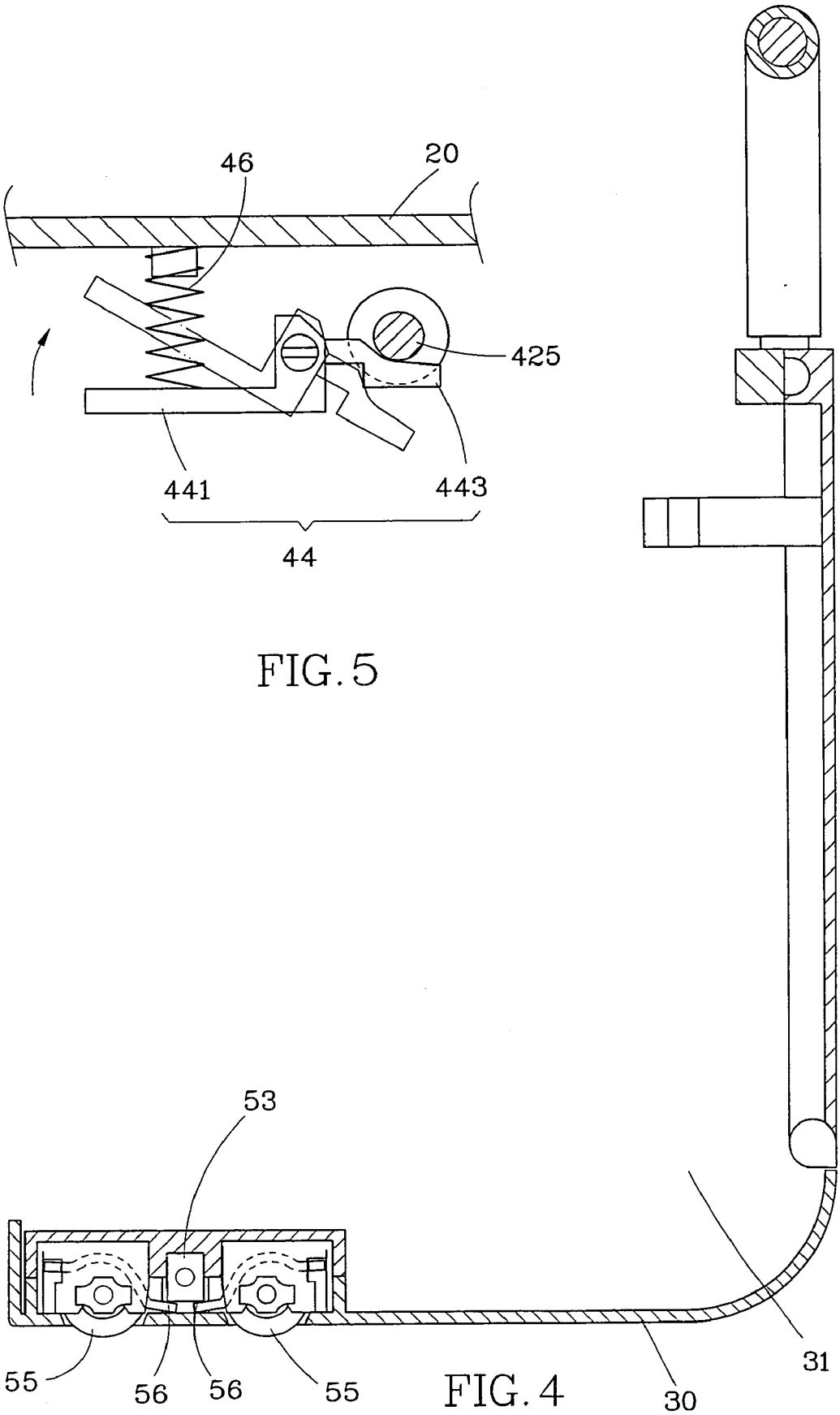
FIG. 4 is a schematic sectional view of the preferred embodiment of the present invention, showing that the cover shell is opened from the base shell and the movable plates are disengaged from the respective latches.
FIG. 5 is a schematic drawing showing the action of the control plate relative to the neck of the straight endpiece of the shackle according to the preferred embodiment of the present invention.

When the user would like to open the padlock 10, he/she needs to rotate the numbered wheels of the two numbered wheel sets 55 to show the correct combination for each numbered wheel set 55. At this time, the movable plates 56 are biased relative to the two latches 53 and respectively disengaged from the latches 53 as shown in FIG. 4. At this time, the user can pull the cover shell 30 outwards from the base shell 20 to open the storage chamber 31, and then press the actuating portion 441 of the control member 44 to disengage the retaining portion 443 from the neck 425 of the straight endpiece 423 of the shackle 42, as shown in FIG. 5, thereby unlocking the shackle 42. Thus, the user can use the padlock 10 to lock things, and can keep a memo or any of a variety of small items in the storage chamber 31. Thereafter, the user can close the cover shell 30 on the base shell 20, and then rotate the numbered wheels of each numbered wheel set 55 to show a wrong number combination respectively. At this time, the movable plates 56 are biased and stopped against the rear ends of the latches 53, so that the tongues 532 of the latches 53 will be positively engaged with the inner notches 212 of the posts 21; therefore, the cover shell 30 is locked to the base shell 20.

As indicated above, the padlock 10 uses two numbered wheel sets 55 to control the latches 53 in locking/unlocking the cover shell 30. The use of the two numbered wheel sets 55 greatly complicates the riddle of the number combinations, increasing the security level. Further, the storage chamber 31 of the padlock 10 can be used to keep keys, memos, or other small items.

Figure 6:
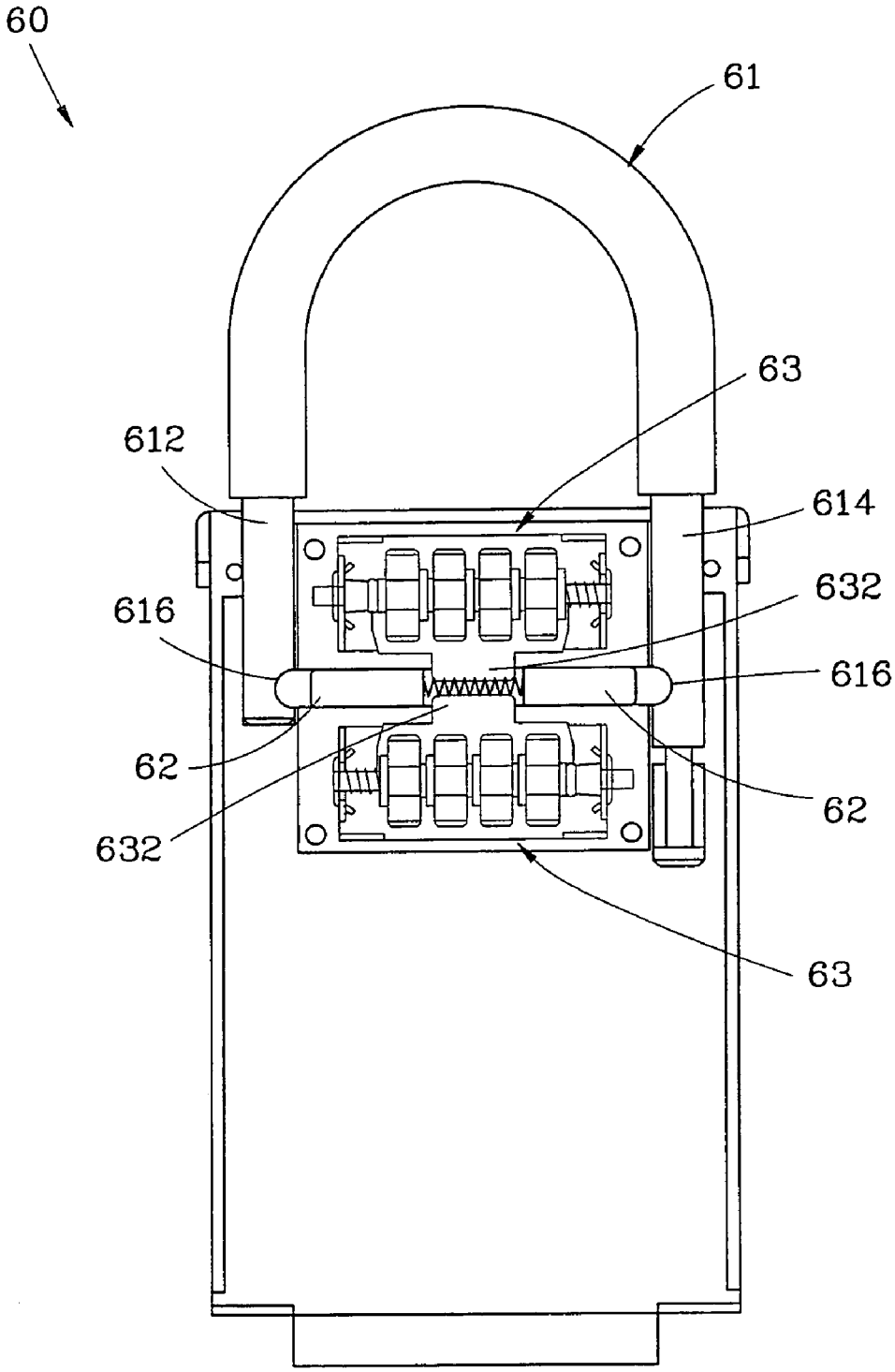
FIG. 6 is a front view of a second preferred embodiment of the padlock according to the present invention; wherein the cover shell is removed for better understanding.

FIG. 6 shows an alternate preferred embodiment of the present invention. According to this embodiment, the padlock 60 is substantially similar to the aforesaid first embodiment with the exception that the shackle 61 has two straight endpieces 612 and 614 and a notch 616 at each of the straight endpieces 612 and 614. When the two numbered wheel sets 63 respectively show the correct number combination, the two movable plates 632 are moved away from the respective latches 62, allowing disengagement of the latches 62 from the notches 616 of the straight endpieces 612 and 614, thereby unlocking the shackle 61. The padlock 60 of this second embodiment achieves the same effects as the aforesaid first embodiment.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A padlock comprising:

a base shell;

a cover shell pivoted to said base shell and closable on said base shell to define with said base shell a storage chamber therebetween, said cover shell having a plurality of through holes in communication with said storage chamber;

a shackle assembly having a shackle movably mounted in said base shell; and two combination lock sets mounted to said cover shell inside said storage chamber, each of said combination lock sets having a latch engagable with said base shell for locking said cover shell to said base shell, a plurality of numbered wheels respectively peripherally extending out of said through holes of said cover shell, and a movable plate actuatable by said numbered wheels to move relative to said latch for engaging or disengaging said latch to further have said latch engage or disengage with said base shell so as to lock or unlock said cover shell to said base shell.

2. The padlock as claimed in claim 1, wherein said shackle assembly further comprises a control member pivoted to said base shell and turnable to lock or unlock said shackle.

3. The padlock as claimed in claim 1, wherein said shackle comprises a shackle body pivoted to said base shell, and a straight endpiece axially extending from one end of said shackle body and rotatable and axially movable with said shackle body relative to said base shell.

4. The padlock as claimed in claim 1, wherein said base shell has two posts bilaterally perpendicularly extending from a front side thereof, said posts each having an inner notch for the engagement of said latches.

5. The padlock as claimed in claim 4, further comprising a spring member stopped between the two latches to force the two latches into engagement with the inner notches of said posts.

6. A padlock comprising:

a base shell;

a cover shell pivoted to said base shell and closable on said base shell to define with said base shell a storage chamber therebetween, said cover shell having a plurality of through holes in communication with said storage chamber;

a shackle assembly having a shackle movably mounted in said base shell; and two combination lock sets mounted to said cover shell inside said storage chamber, each of said combination lock sets having a latch engagable with said shackle for locking said cover shell to said base shell, a plurality of numbered wheels respectively peripherally extending out of said through holes of said cover shell, and a movable plate actuatable by said numbered wheels to move relative to said latch for engaging or disengaging said latch to further have said latch engage or disengage with said shackle.

7. The padlock as claimed in claim 6, wherein said shackle comprises a shackle body pivoted to said base shell, and a straight endpiece axially extending from one end of said shackle body and rotatable and axially movable with said shackle body relative to said base shell.

8. The padlock as claimed in claim 6, further comprising a spring member stopped between said two latches to force said two latches into engagement with said shackle.

* * * * *